US010550791B2

(12) United States Patent
Zeng et al.

(10) Patent No.: US 10,550,791 B2
(45) Date of Patent: Feb. 4, 2020

(54) METHODS AND SYSTEMS FOR FUEL RAIL PRESSURE RELIEF

(71) Applicant: Ford Global Technologies, LLC, Dearborn, MI (US)

(72) Inventors: Paul Zeng, Inkster, MI (US); Mark L. Stickler, Novi, MI (US); Kwan Jamal Barber, Southfield, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 74 days.

(21) Appl. No.: 15/978,562

(22) Filed: May 14, 2018

(65) Prior Publication Data

US 2018/0258876 A1 Sep. 13, 2018

Related U.S. Application Data

(63) Continuation of application No. 15/331,744, filed on Oct. 21, 2016, now Pat. No. 9,970,379.

(60) Provisional application No. 62/300,997, filed on Feb. 29, 2016.

(51) Int. Cl.

| | |
|---|---|
| ***F02D 41/30*** | (2006.01) |
| ***F02D 41/38*** | (2006.01) |
| ***F02D 41/32*** | (2006.01) |
| ***F02M 63/00*** | (2006.01) |
| ***F02M 63/02*** | (2006.01) |

(52) U.S. Cl.

CPC ..... *F02D 41/3094* (2013.01); *F02D 41/32* (2013.01); *F02D 41/3863* (2013.01); *F02D 41/3872* (2013.01); *F02M 63/005* (2013.01); *F02M 63/025* (2013.01); *F02D 2041/389* (2013.01); *F02D 2200/0602* (2013.01); *F02M 63/0245* (2013.01)

(58) Field of Classification Search

CPC ..... F02D 41/3094; F02D 41/3836; F02D 41/3845; F02D 41/3863; F02D 41/3872; F02D 2250/02; F02D 2250/04; F02D 2250/31; F02M 63/025; F02M 63/026

USPC ..... 123/431

See application file for complete search history.

(56) References Cited

U.S. PATENT DOCUMENTS

| | | | | |
|---|---|---|---|---|
| 7,013,872 | B2 * | 3/2006 | Yamazaki | F02D 41/3094 123/431 |
| 8,091,530 | B2 | 1/2012 | Sumilla et al. | |
| 8,997,714 | B2 | 4/2015 | Rumpsa | |
| 9,453,476 | B2 | 9/2016 | Rumpsa | |
| 9,771,909 | B2 | 9/2017 | Pursifull | |
| 2005/0098155 | A1 | 5/2005 | Yamazaki et al. | |
| 2005/0193982 | A1 | 9/2005 | Sakai et al. | |
| 2006/0000452 | A1 | 1/2006 | Tokuda et al. | |

(Continued)

*Primary Examiner* — Erick R Solis

(74) *Attorney, Agent, or Firm* — Geoffrey Brumbaugh; McCoy Russell LLP

(57) ABSTRACT

Methods and systems are provided for adjusting operation of fuel injectors of an internal combustion engine to reduce injector ticking noise during direct injection fuel rail pressure release. The method includes first reducing a significant part of the direct injection fuel rail pressure via a mechanical high pressure pump relief valve and only if further pressure relief is required then intermittently activating the direct injector to inject in small amount of fuel. Due to the reduced frequency of activation and small pulse-widths, the impact force transmitted from injectors to cylinder head is small thereby reducing the objectionable ticking noise.

17 Claims, 6 Drawing Sheets

(56) References Cited

U.S. PATENT DOCUMENTS

| | | | |
|---|---|---|---|
| 2006/0254562 | A1 | 11/2006 | Akita |
| 2014/0076283 | A1 | 3/2014 | Pursifull |
| 2015/0033753 | A1 | 2/2015 | Dooley |

* cited by examiner

510

| TKI comparison: DI inj MM vs. PRV | | | | | |
|---|---|---|---|---|---|
| 17MY 3.5L GT-PFDI VP2 P552, Oct. 14, 2015 | | | | | |
| Mic | PFI TKI targets | DI inj MM | PFI | PRV | Delta TKI vs. targets |
| DOE | ≤ 9.5 | 8.6 | 7.9 | 7.9 | |
| Driver wheel | ≤ 12 | 13.2 | 10.6 | 10.1 | 1.2 |
| Driver door | ≤ 12 | 12.9 | 10.6 | 9.4 | 0.9 |
| Passenger wheel | ≤ 12.5 | 13.6 | 11.5 | 10.6 | 1.1 |
| Front | ≤ 12.5 | 13.8 | 12.1 | 11.5 | 1.3 |
| Avg delta | | | | | 1.1 |

METHODS AND SYSTEMS FOR FUEL RAIL PRESSURE RELIEF

CROSS REFERENCE TO RELATED APPLICATIONS

The present application is a continuation of U.S. patent application Ser. No. 15/331,744, entitled "Methods and Systems for Fuel Rail Pressure Relief," filed on Oct. 21, 2016. U.S. patent application Ser. No. 15/331,744 claims priority to U.S. Provisional Patent Application No. 62/300,997 entitled "Methods and Systems for Fuel Rail Pressure Relief," filed on Feb. 29, 2016. The entire contents of the above-referenced applications are hereby incorporated by reference in their entirety for all purposes.

FIELD

The present application relates generally to systems and methods for adjusting operation of fuel injectors of an internal combustion engine to reduce injector ticking noise.

BACKGROUND/SUMMARY

Engines may be configured to deliver fuel to an engine cylinder using one or more of port and direct injection. Port fuel direct injection (PFDI) engines are capable of leveraging both fuel injection systems. For example, at high engine loads, fuel may be directly injected into an engine cylinder via a direct injector, thereby leveraging the charge cooling properties of the direct injection (DI). At lower engine loads and at engine starts, fuel may be injected into an intake port of the engine cylinder via a port fuel injector, reducing particulate matter emissions. During still other conditions, a portion of fuel may be delivered to the cylinder via the port injector while a remainder of the fuel is delivered to the cylinder via the direct injector.

During periods of engine operation where direct injection of fuel is disabled and no fuel is being released by the direct injector (e.g., during conditions where only port injection of fuel is scheduled), fuel trapped inside the DI fuel rail may expand due to high temperatures. This can result in a pressure build-up in the DI fuel rail as well as elevated injector tip temperatures. If the deactivation period of the DI is long, the pressure built up may be significant. Prolonged exposure to such high pressure conditions may cause damage to the fuel system components. To address this, while direct injection is disabled, a small amount of fuel may be intermittently released from the direct injectors in order to bleed-off the excess pressure in the direct injection fuel rail and lower the injector tip temperature.

However, the inventors have identified potential issues with the above mentioned approach. As one example, activation of the direct injectors for DI fuel rail pressure relief generates a high impact force that is transmitted from the injectors onto the engine cylinder heads. This produces a ticking noise in the vehicle that may be objectionable to the vehicle operator. As such, the higher the rail pressure, the louder the ticking noise that is generated. Additionally, if the port injection is being used during engine idling, where the engine noise is low, there may not be sufficient engine noise to mask the ticking noise, making the ticking noise more audible and objectionable to the operator. In addition, the high pressure imparted by the direct injected fuel on the cylinder heads can damage the cylinder head, resulting in warranty issues.

In one example, the above issues may be at least partly addressed by a method for an engine comprising: during an engine warm idling condition, maintaining direct injectors disabled until a direct injection fuel rail pressure is reduced via a high pressure pump relief valve; and then further reducing the direct injection fuel rail pressure via intermittent activation of the direct injectors. In this way, the pressure at the direct injection fuel rail may be relieved with reduced ticking noise.

As an example, an engine may be configured with each of port and direct fuel injection. Fuel may be delivered to the port injection fuel rail via a low pressure lift pump. Pressurized fuel may then be delivered to the direct injection fuel rail via a high pressure pump (HPP) receiving fuel from the low pressure lift pump (LPP). During warm idling conditions, fuel may be delivered to the engine via port injection only and the direct injectors may be disabled. Consequently, pressure may build up from fuel trapped at the direct injection fuel rail, resulting in an elevated pressure being experienced at the HPP. A controller may determine an amount of pressure relief required based at least on a duration of direct injector deactivation (or a duration of PFI only operation), and further based on engine operating conditions. The DI rail pressure may then be relieved while maintaining the direct injectors disabled. As a first step, as the rail pressure exceeds a first threshold pressure that corresponds to a high pressure (HP) pump relief pressure, a pump relief valve coupled to the HPP may intermittently open (e.g., automatically via mechanical actuation) to maintain the rail pressure at the first threshold pressure. If further pressure relief is required, such as when a duration of DI deactivation is longer than a threshold duration, the direct injectors may be intermittently activated to deliver a small pulse of fuel into the cylinders. By relieving at least some of the pressure via the pump relief valve, the additional pressure relief required via the direct injectors (if required) may entail a smaller number of fuel pulses as well as fuel pulses of a smaller pulse-width than would have been required if only direct injection were used for pressure relief. Due to the smaller size and number of fuel pulses, as well as the lower fuel rail pressure at which the injectors are activated, the impact force transmitted from the injection onto the engine cylinder heads may be substantially lower (e.g., negligible), resulting in reduced occurrence of objectionable ticking noise. In addition, damage to fuel system components is reduced.

In this way, pressure may be relieved from a DI fuel rail and at a related HPP with less generation of objectionable noise, such as less ticking noise. By enabling DI fuel rail pressure to be reduced below a relief threshold of the HPP via operation of the pump relief valve, the direct injectors may be maintained deactivated for a longer duration, reducing the occurrence of ticking. Even when the direct injectors are activated for pressure relief, since a smaller degree of pressure relief is required via the injectors, due to the pressure relief provided via the pump relief valve, the amount of objectionable noise generated may be substantially lower, or negligible. As such, the lower volume ticking noise may be low enough to be masked by engine noise such that it is not audible (or objectionable) to the operator. Also, by reducing the impact force on the cylinder head from the direct injection, component life is extended, reducing warranty issues.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 4:
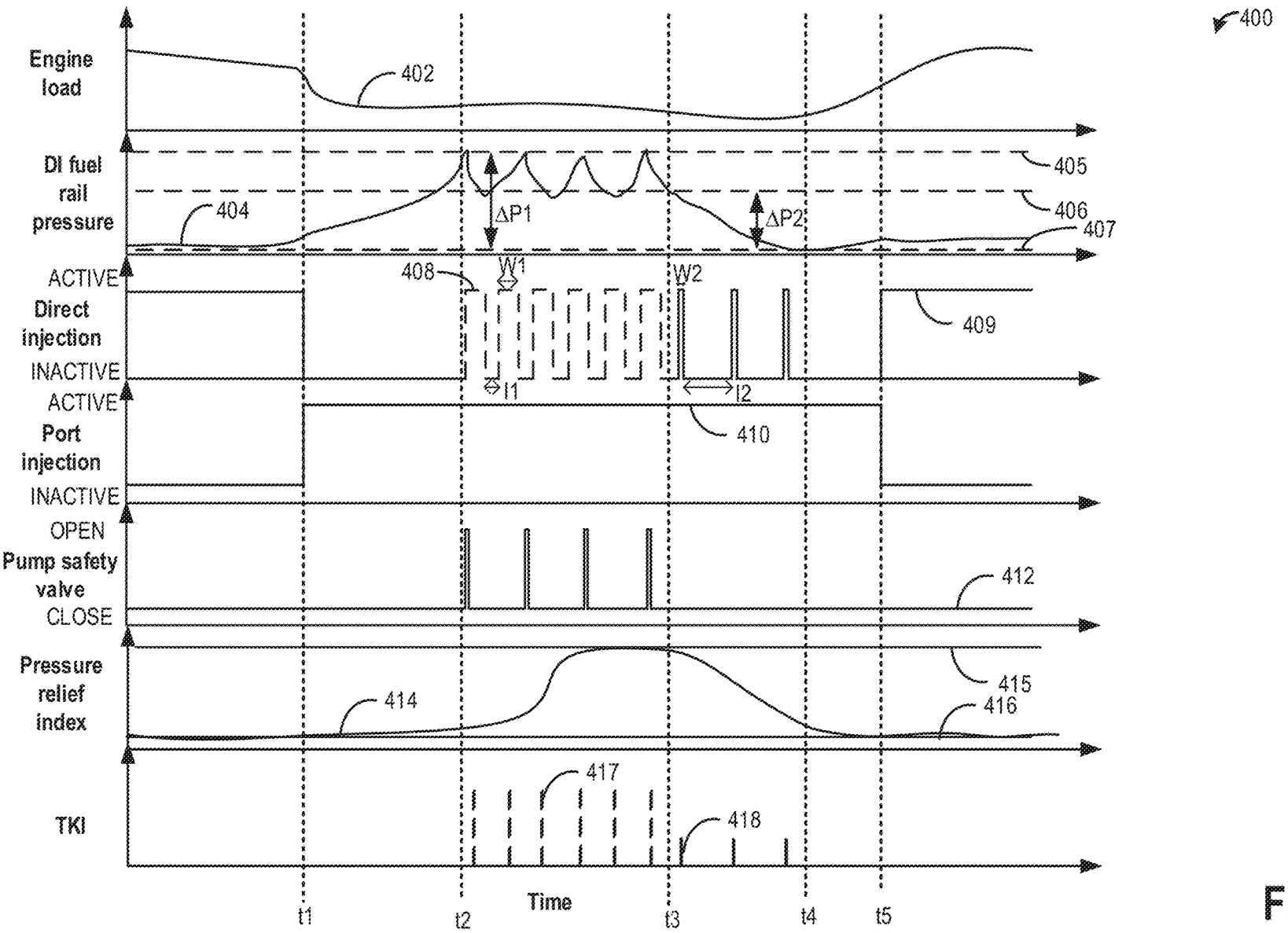
FIG. 4 shows an example operation of the fuel system for reduction of direct injection fuel rail pressure.
Figures 5A, 5B:
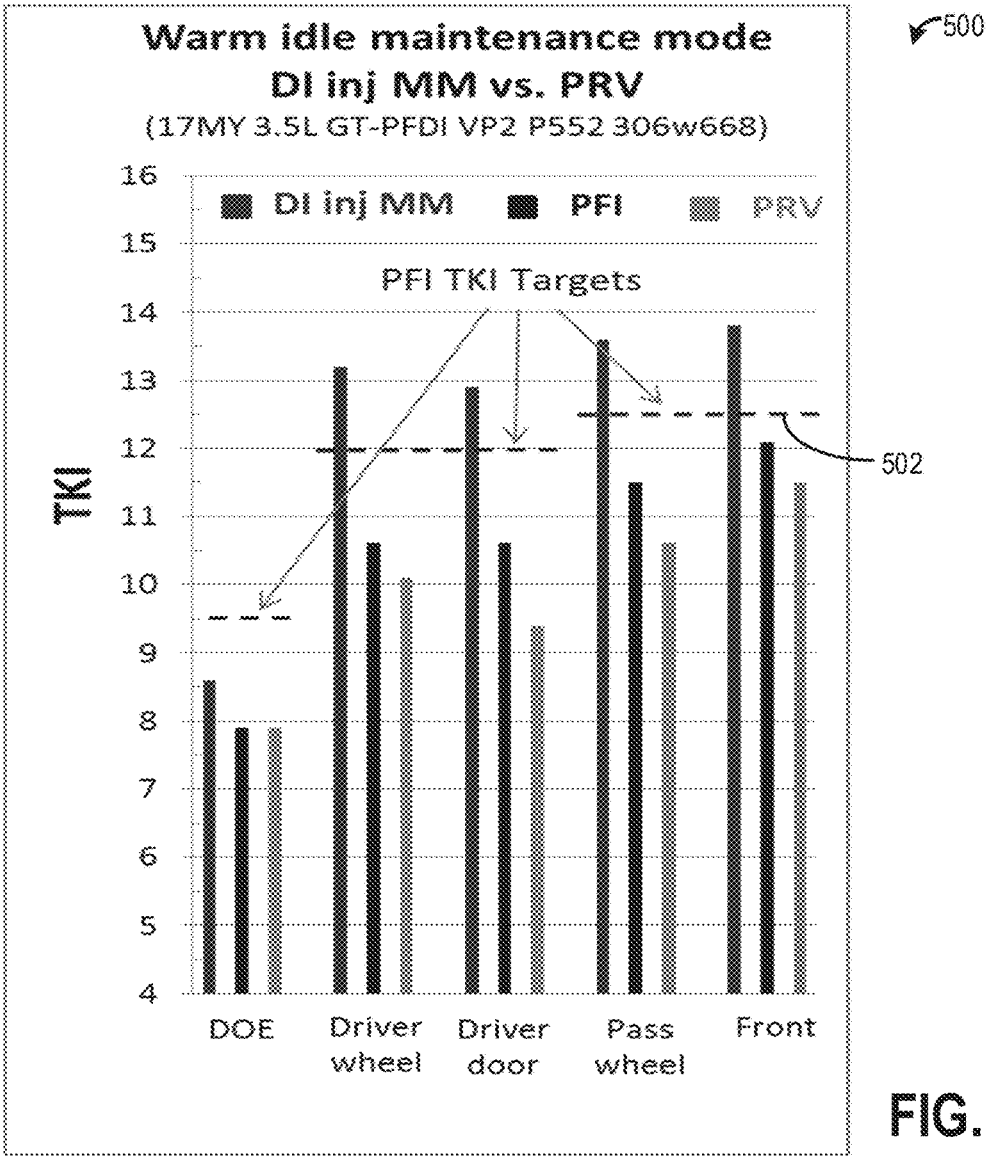
FIG. 5A shows an example bar chart comparing ticking noise levels produced by different methods for DI fuel rail pressure relief.
FIG. 5B shows an example table comparing ticking noise levels produced by different methods for DI fuel rail pressure relief.
Figure 6:
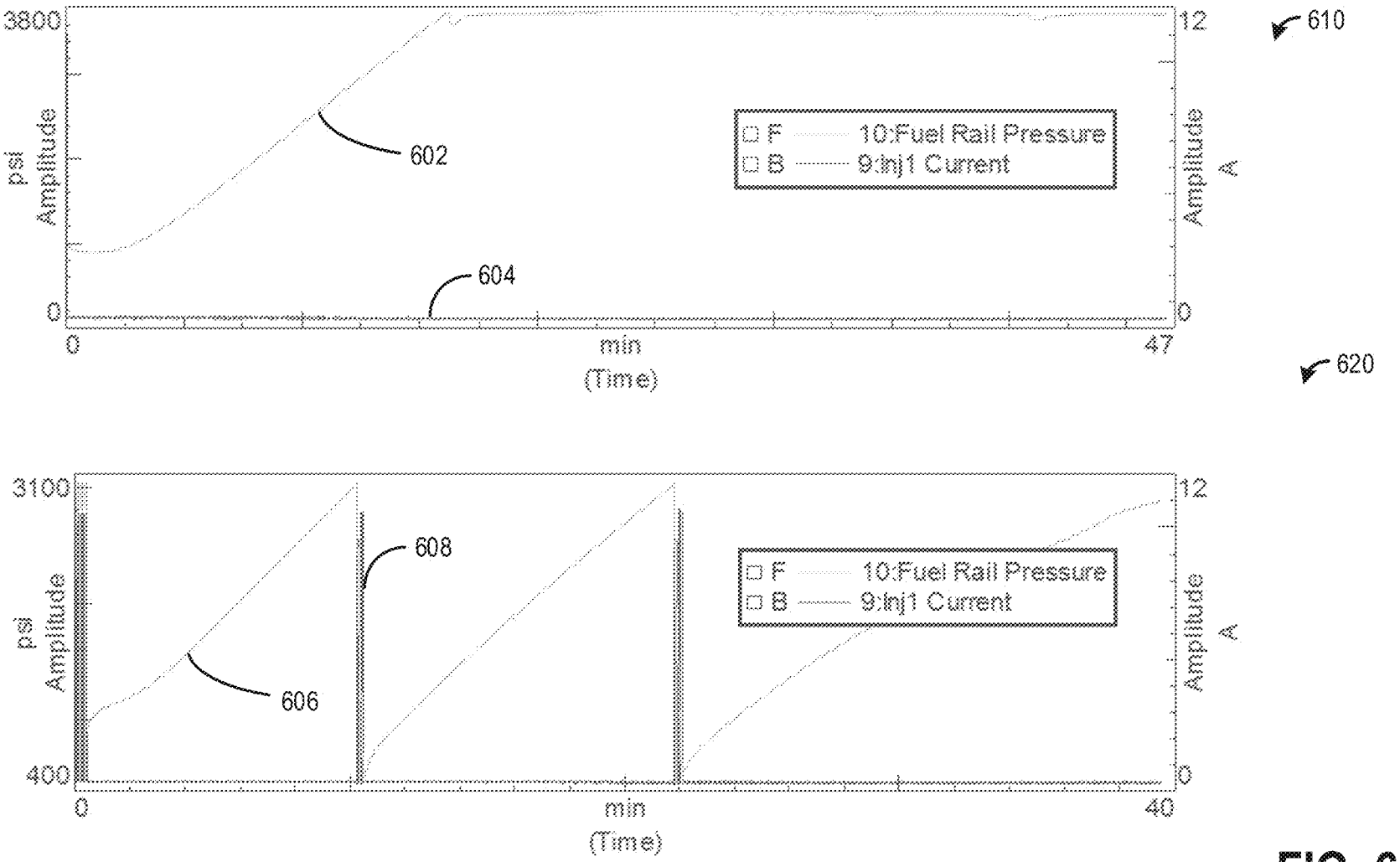
FIG. 6 shows example plots of DI fuel rail pressure relief using different techniques.

The following description relates to systems and methods for adjusting operation of fuel injectors of an internal combustion engine to reduce injector ticking noise. An example embodiment of a cylinder in an internal combustion engine with each of a direct injector and a port injector is given in FIG. 1. FIG. 2 depicts a fuel system that may be used with the engine of FIG. 1. Pressurized fuel may be delivered to a direct injection fuel rail in the fuel system via a high pressure pump receiving fuel from a low pressure lift pump. During certain engine operating conditions, fuel may be delivered to the engine via port injection only and the direct injectors may be disabled. During prolonged period of deactivation of the direct injectors, pressure may build up in the direct injection (DI) fuel rail. A method for relieving DI fuel rail pressure with reduced ticking noise of the direct injector is shown with reference to FIG. 3. For example, a pressure relief valve coupled to the high pressure pump may be utilized together with intermittent DI, as shown in FIG. 4. FIGS. 5A-5B show an example bar chart and a table comparing ticking noise levels produced by different methods (such as DI, pump relief valve pressure release) for DI fuel rail pressure relief. FIG. 6 shows example plots of DI fuel rail pressure relief using such techniques.

Regarding terminology used throughout this detailed description, a high pressure pump, or direct injection pump, may be abbreviated as a HPP. Similarly, a low pressure pump, or lift pump, may be abbreviated as a LPP. Port fuel injection may be abbreviated as PFI while direct injection may be abbreviated as DI. Also, fuel rail pressure, or the value of pressure of fuel within a fuel rail, may be abbreviated as FRP.

Figure 1:
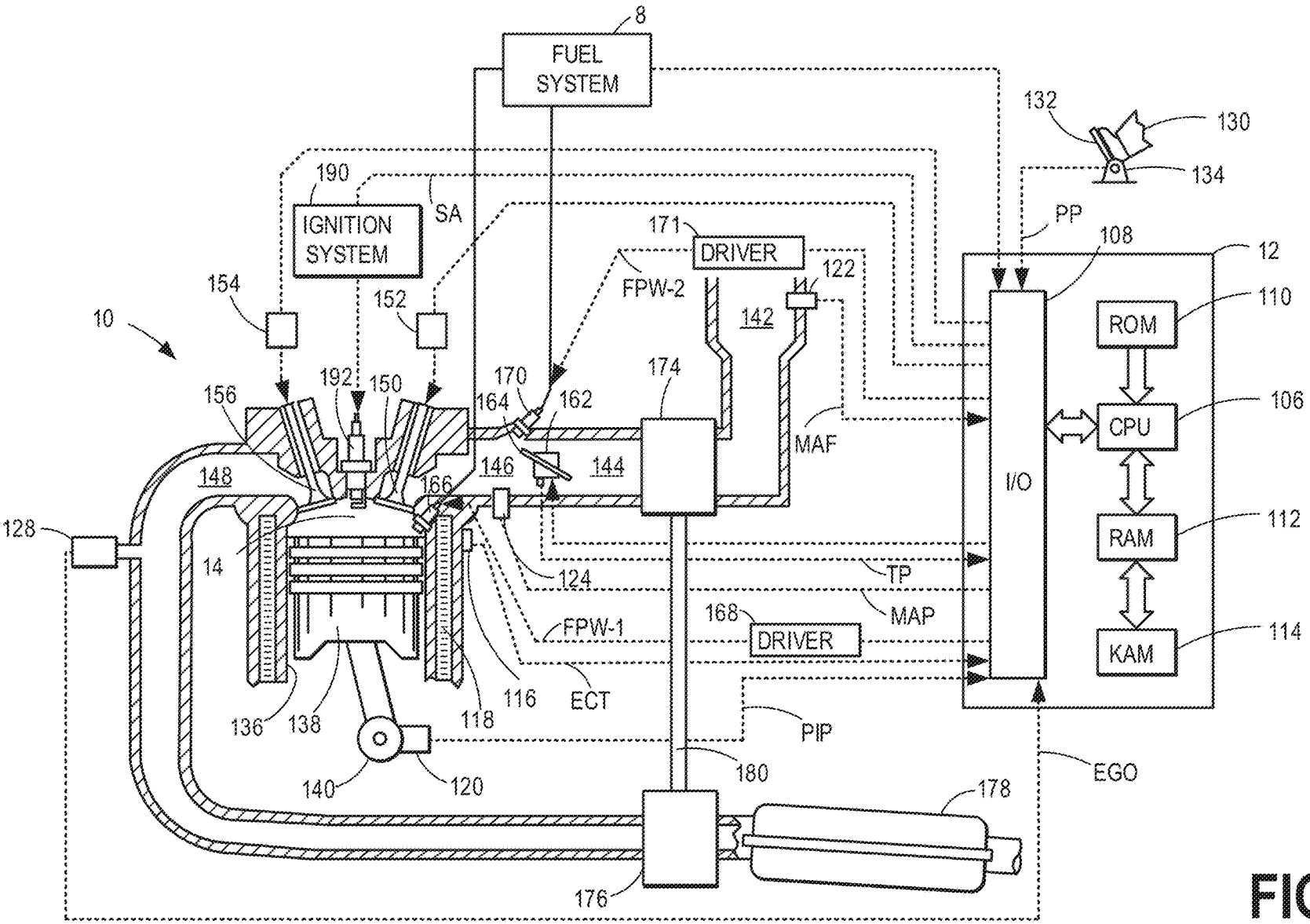
FIG. 1 schematically depicts an example embodiment of a cylinder of an internal combustion engine.
Figure 2:
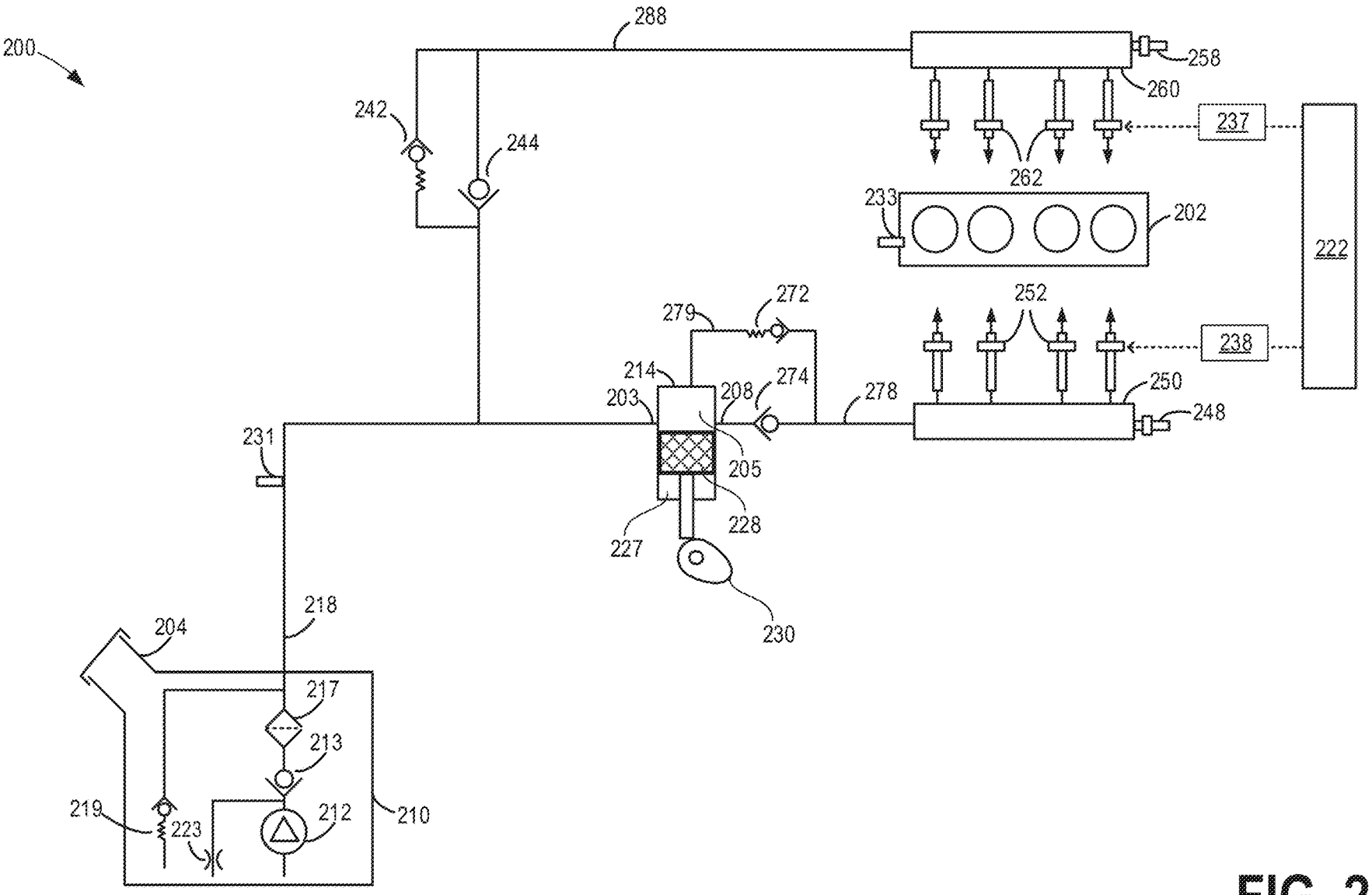
FIG. 2 schematically depicts an example embodiment of a fuel system, configured for port injection and direct injection that may be used with the engine of FIG. 1.

FIG. 1 depicts an example of a combustion chamber or cylinder of internal combustion engine 10. Engine 10 may be controlled at least partially by a control system including controller 12 and by input from a vehicle operator 130 via an input device 132. In this example, input device 132 includes an accelerator pedal and a pedal position sensor 134 for generating a proportional pedal position signal PP. Cylinder (herein also "combustion chamber") 14 of engine 10 may include combustion chamber walls 136 with piston 138 positioned therein. Piston 138 may be coupled to crankshaft 140 so that reciprocating motion of the piston is translated into rotational motion of the crankshaft. Crankshaft 140 may be coupled to at least one drive wheel of the passenger vehicle via a transmission system. Further, a starter motor (not shown) may be coupled to crankshaft 140 via a flywheel to enable a starting operation of engine 10.

Cylinder 14 can receive intake air via a series of intake air passages 142, 144, and 146. Intake air passage 146 can communicate with other cylinders of engine 10 in addition to cylinder 14. In some examples, one or more of the intake passages may include a boosting device such as a turbocharger or a supercharger. For example, FIG. 1 shows engine 10 configured with a turbocharger including a compressor 174 arranged between intake passages 142 and 144, and an exhaust turbine 176 arranged along exhaust passage 148. Compressor 174 may be at least partially powered by exhaust turbine 176 via a shaft 180 where the boosting device is configured as a turbocharger. However, in other examples, such as where engine 10 is provided with a supercharger, exhaust turbine 176 may be optionally omitted, where compressor 174 may be powered by mechanical input from a motor or the engine. A throttle 162 including a throttle plate 164 may be provided along an intake passage of the engine for varying the flow rate and/or pressure of intake air provided to the engine cylinders. For example, throttle 162 may be positioned downstream of compressor 174 as shown in FIG. 1, or alternatively may be provided upstream of compressor 174.

Exhaust passage 148 can receive exhaust gases from other cylinders of engine 10 in addition to cylinder 14. Exhaust gas sensor 128 is shown coupled to exhaust passage 148 upstream of emission control device 178. Sensor 128 may be selected from among various suitable sensors for providing an indication of exhaust gas air/fuel ratio such as a linear oxygen sensor or UEGO (universal or wide-range exhaust gas oxygen), a two-state oxygen sensor or EGO (as depicted), a HEGO (heated EGO), a NOx, HC, or CO sensor, for example. Emission control device 178 may be a three way catalyst (TWC), NOx trap, various other emission control devices, or combinations thereof.

Each cylinder of engine 10 may include one or more intake valves and one or more exhaust valves. For example, cylinder 14 is shown including at least one intake poppet valve 150 and at least one exhaust poppet valve 156 located at an upper region of cylinder 14. In some examples, each cylinder of engine 10, including cylinder 14, may include at least two intake poppet valves and at least two exhaust poppet valves located at an upper region of the cylinder.

Intake valve 150 may be controlled by controller 12 via actuator 152. Similarly, exhaust valve 156 may be controlled by controller 12 via actuator 154. During some conditions, controller 12 may vary the signals provided to actuators 152 and 154 to control the opening and closing of the respective intake and exhaust valves. The position of intake valve 150 and exhaust valve 156 may be determined by respective valve position sensors (not shown). The valve actuators may be of the electric valve actuation type or cam actuation type, or a combination thereof. The intake and exhaust valve timing may be controlled concurrently or any of a possibility of variable intake cam timing, variable exhaust cam timing, dual independent variable cam timing or fixed cam timing may be used. Each cam actuation system may include one or more cams and may utilize one or more of cam profile switching (CPS), variable cam timing (VCT), variable valve timing (VVT) and/or variable valve lift (VVL) systems that may be operated by controller 12 to vary valve operation. For example, cylinder 14 may alternatively include an intake valve controlled via electric valve actuation and an exhaust valve controlled via cam actuation including CPS and/or VCT. In other examples, the intake and exhaust valves may be controlled by a common valve actuator or actuation system, or a variable valve timing actuator or actuation system.

Cylinder 14 can have a compression ratio, which is the ratio of volumes when piston 138 is at bottom center to top center. In one example, the compression ratio is in the range of 9:1 to 10:1. However, in some examples where different fuels are used, the compression ratio may be increased. This may happen, for example, when higher octane fuels or fuels with higher latent enthalpy of vaporization are used. The compression ratio may also be increased if direct injection is used due to its effect on engine knock.

In some examples, each cylinder of engine 10 may include a spark plug 192 for initiating combustion. Ignition system 190 can provide an ignition spark to combustion chamber 14 via spark plug 192 in response to spark advance signal SA from controller 12, under select operating modes. However, in some embodiments, spark plug 192 may be omitted, such as where engine 10 may initiate combustion by auto-ignition or by injection of fuel as may be the case with some diesel engines.

In some examples, each cylinder of engine 10 may be configured with one or more fuel injectors for providing fuel thereto. As a non-limiting example, cylinder 14 is shown including two fuel injectors 166 and 170. Fuel injectors 166 and 170 may be configured to deliver fuel received from fuel system 8. As elaborated with reference to FIGS. 2 and 3, fuel system 8 may include one or more fuel tanks, fuel pumps, and fuel rails. Fuel injector 166 is shown coupled directly to cylinder 14 for injecting fuel directly therein in proportion to the pulse width of signal FPW-1 received from controller 12 via electronic driver 168. In this manner, fuel injector 166 provides what is known as direct injection (hereafter referred to as "DI") of fuel into combustion cylinder 14. While FIG. 1 shows injector 166 positioned to one side of cylinder 14, it may alternatively be located overhead of the piston, such as near the position of spark plug 192. Such a position may improve mixing and combustion when operating the engine with an alcohol-based fuel due to the lower volatility of some alcohol-based fuels. Alternatively, the injector may be located overhead and near the intake valve to improve mixing. Fuel may be delivered to fuel injector 166 from a fuel tank of fuel system 8 via a high pressure fuel pump, and a fuel rail. Further, the fuel tank may have a pressure transducer providing a signal to controller 12.

Fuel injector 170 is shown arranged in intake passage 146, rather than in cylinder 14, in a configuration that provides what is known as port injection of fuel (hereafter referred to as "PFI") into the intake port upstream of cylinder 14. Fuel injector 170 may inject fuel, received from fuel system 8, in proportion to the pulse width of signal FPW-2 received from controller 12 via electronic driver 171. Note that a single driver 168 or 171 may be used for both fuel injection systems, or multiple drivers, for example driver 168 for fuel injector 166 and driver 171 for fuel injector 170, may be used, as depicted.

In an alternate example, each of fuel injectors 166 and 170 may be configured as direct fuel injectors for injecting fuel directly into cylinder 14. In still another example, each of fuel injectors 166 and 170 may be configured as port fuel injectors for injecting fuel upstream of intake valve 150. In yet other examples, cylinder 14 may include only a single fuel injector that is configured to receive different fuels from the fuel systems in varying relative amounts as a fuel mixture, and is further configured to inject this fuel mixture either directly into the cylinder as a direct fuel injector or upstream of the intake valves as a port fuel injector. As such, it should be appreciated that the fuel systems described herein should not be limited by the particular fuel injector configurations described herein by way of example.

Fuel may be delivered by both injectors to the cylinder during a single cycle of the cylinder. For example, each injector may deliver a portion of a total fuel injection that is combusted in cylinder 14. Further, the distribution and/or relative amount of fuel delivered from each injector may vary with operating conditions, such as engine load, knock, and exhaust temperature, such as described herein below. The port injected fuel may be delivered during an open intake valve event, closed intake valve event (e.g., substantially before the intake stroke), as well as during both open and closed intake valve operation. Similarly, directly injected fuel may be delivered during an intake stroke, as well as partly during a previous exhaust stroke, during the intake stroke, and partly during the compression stroke, for example. As such, even for a single combustion event, injected fuel may be injected at different timings from the port and direct injector. Furthermore, for a single combustion event, multiple injections of the delivered fuel may be performed per cycle. The multiple injections may be performed during the compression stroke, intake stroke, or any appropriate combination thereof.

Fuel injectors 166 and 170 may have different characteristics. These include differences in size, for example, one injector may have a larger injection hole than the other. Other differences include, but are not limited to, different spray angles, different operating temperatures, different targeting, different injection timing, different spray characteristics, different locations etc. Moreover, depending on the distribution ratio of injected fuel among injectors 170 and 166, different effects may be achieved.

Fuel tanks in fuel system 8 may hold fuels of different fuel types, such as fuels with different fuel qualities and different fuel compositions. The differences may include different alcohol content, different water content, different octane, different heats of vaporization, different fuel blends, and/or combinations thereof etc. One example of fuels with different heats of vaporization could include gasoline as a first fuel type with a lower heat of vaporization and ethanol as a second fuel type with a greater heat of vaporization. In another example, the engine may use gasoline as a first fuel type and an alcohol containing fuel blend such as E85 (which is approximately 85% ethanol and 15% gasoline) or M85 (which is approximately 85% methanol and 15% gasoline) as a second fuel type. Other feasible substances include water, methanol, a mixture of alcohol and water, a mixture of water and methanol, a mixture of alcohols, etc.

In still another example, both fuels may be alcohol blends with varying alcohol composition wherein the first fuel type may be a gasoline alcohol blend with a lower concentration of alcohol, such as E10 (which is approximately 10% ethanol), while the second fuel type may be a gasoline alcohol blend with a greater concentration of alcohol, such as E85 (which is approximately 85% ethanol). Additionally, the first and second fuels may also differ in other fuel qualities such as a difference in temperature, viscosity, octane number, etc. Moreover, fuel characteristics of one or both fuel tanks may vary frequently, for example, due to day to day variations in tank refilling.

Controller 12 is shown in FIG. 1 as a microcomputer, including microprocessor unit 106, input/output ports 108, an electronic storage medium for executable programs and calibration values shown as non-transitory read only memory chip 110 in this particular example for storing executable instructions, random access memory 112, keep alive memory 114, and a data bus. Controller 12 may receive various signals from sensors coupled to engine 10, in addition to those signals previously discussed, including measurement of inducted mass air flow (MAF) from mass air flow sensor 122; engine coolant temperature (ECT) from temperature sensor 116 coupled to cooling sleeve 118; a profile ignition pickup signal (PIP) from Hall effect sensor 120 (or other type) coupled to crankshaft 140; throttle position (TP) from a throttle position sensor; and absolute manifold pressure signal (MAP) from sensor 124. Engine speed signal, RPM, may be generated by controller 12 from signal PIP. Manifold pressure signal MAP from a manifold pressure sensor may be used to provide an indication of vacuum, or pressure, in the intake manifold. The controller 12 receives signals from the various sensors of FIG. 1 and employs the various actuators of FIG. 1 to adjust engine operation based on the received signals and instructions stored on a memory of the controller.

As described above, FIG. 1 shows only one cylinder of a multi-cylinder engine. As such, each cylinder may similarly include its own set of intake/exhaust valves, fuel injector(s), spark plug, etc. It will be appreciated that engine 10 may include any suitable number of cylinders, including 2, 3, 4, 5, 6, 8, 10, 12, or more cylinders. Further, each of these cylinders can include some or all of the various components described and depicted by FIG. 1 with reference to cylinder 14.

FIG. 2 schematically depicts an example embodiment 200 of a fuel system, such as fuel system 8 of FIG. 1. Fuel system 200 may be operated to deliver fuel to an engine, such as engine 10 of FIG. 1. Fuel system 200 may be operated by a controller to perform some or all of the operations described with reference to the method of FIG. 3.

Fuel system 200 includes a fuel storage tank 210 for storing the fuel on-board the vehicle, a lower pressure fuel pump (LPP) 212 (herein also referred to as fuel lift pump 212), and a higher pressure fuel pump (HPP) 214 (herein also referred to as fuel injection pump 214). Fuel may be provided to fuel tank 210 via fuel filling passage 204. In one example, LPP 212 may be an electrically-powered lower pressure fuel pump disposed at least partially within fuel tank 210. LPP 212 may be operated by a controller 222 (e.g., controller 12 of FIG. 1) to provide fuel to HPP 214 via fuel passage 218. LPP 212 can be configured as what may be referred to as a fuel lift pump. As one example, LPP 212 may be a turbine (e.g., centrifugal) pump including an electric (e.g., DC) pump motor, whereby the pressure increase across the pump and/or the volumetric flow rate through the pump may be controlled by varying the electrical power provided to the pump motor, thereby increasing or decreasing the motor speed. For example, as the controller reduces the electrical power that is provided to lift pump 212, the volumetric flow rate and/or pressure increase across the lift pump may be reduced. The volumetric flow rate and/or pressure increase across the pump may be increased by increasing the electrical power that is provided to lift pump 212. As one example, the electrical power supplied to the lower pressure pump motor can be obtained from an alternator or other energy storage device on-board the vehicle (not shown), whereby the control system can control the electrical load that is used to power the lower pressure pump. Thus, by varying the voltage and/or current provided to the lower pressure fuel pump, the flow rate and pressure of the fuel provided at the inlet of the higher pressure fuel pump 214 is adjusted.

LPP 212 may be fluidly coupled to a filter 217, which may remove small impurities contained in the fuel that could potentially damage fuel handling components. A check valve 213, which may facilitate fuel delivery and maintain fuel line pressure, may be positioned fluidly upstream of filter 217. With check valve 213 upstream of the filter 217, the compliance of low-pressure passage 218 may be increased since the filter may be physically large in volume. Furthermore, a pressure relief valve 219 may be employed to limit the fuel pressure in low-pressure passage 218 (e.g., the output from lift pump 212). Relief valve 219 may include a ball and spring mechanism that seats and seals at a specified pressure differential, for example. The pressure differential set-point at which relief valve 219 may be configured to open may assume various suitable values; as a non-limiting example the set-point may be 6.4 bar or 5 bar (g). An orifice 223 may be utilized to allow for air and/or fuel vapor to bleed out of the lift pump 212. This bleed at orifice 223 may also be used to power a jet pump used to transfer fuel from one location to another within the tank 210. In one example, an orifice check valve (not shown) may be placed in series with orifice 223. In some embodiments, fuel system 8 may include one or more (e.g., a series) of check valves fluidly coupled to low-pressure fuel pump 212 to impede fuel from leaking back upstream of the valves. In this context, upstream flow refers to fuel flow traveling from fuel rails 250, 260 towards LPP 212 while downstream flow refers to the nominal fuel flow direction from the LPP towards the HPP 214 and thereon to the fuel rails.

Fuel lifted by LPP 212 may be supplied at a lower pressure into a fuel passage 218 leading to an inlet 203 of HPP 214. HPP 214 may then deliver fuel into a first fuel rail 250 coupled to one or more fuel injectors of a first group of direct injectors 252 (herein also referred to as a first injector group). Fuel lifted by the LPP 212 may also be supplied to a second fuel rail 260 coupled to one or more fuel injectors of a second group of port injectors 262 (herein also referred to as a second injector group). HPP 214 may be operated to raise the pressure of fuel delivered to the first fuel rail above the lift pump pressure, with the first fuel rail coupled to the direct injector group operating with a high pressure. As a result, high pressure DI may be enabled while PFI may be operated at a lower pressure.

While each of first fuel rail 250 and second fuel rail 260 are shown dispensing fuel to four fuel injectors of the respective injector group 252, 262, it will be appreciated that each fuel rail 250, 260 may dispense fuel to any suitable number of fuel injectors. As one example, first fuel rail 250 may dispense fuel to one fuel injector of first injector group 252 for each cylinder of the engine while second fuel rail 260 may dispense fuel to one fuel injector of second injector group 262 for each cylinder of the engine. Controller 222 can individually actuate each of the port injectors 262 via a port injection driver 237 and actuate each of the direct injectors 252 via a direct injection driver 238. The controller 222, the drivers 237, 238 and other suitable engine system controllers can comprise a control system. While the drivers 237, 238 are shown external to the controller 222, it should be appreciated that in other examples, the controller 222 can include the drivers 237, 238 or can be configured to provide the functionality of the drivers 237, 238. Controller 222 may include additional components not shown, such as those included in controller 12 of FIG. 1.

HPP 214 may be an engine-driven, positive-displacement pump. As one non-limiting example, HPP 214 may be a BOSCH HDP5 HIGH PRESSURE PUMP, which utilizes a solenoid activated control valve (e.g., fuel volume regulator, magnetic solenoid valve, etc.) to vary the effective pump volume of each pump stroke. The outlet check valve of HPP is mechanically controlled and not electronically controlled by an external controller. HPP 214 may be mechanically driven by the engine in contrast to the motor driven LPP 212. HPP 214 includes a pump piston 228, a pump compression chamber 205 (herein also referred to as compression chamber), and a step-room 227. Pump piston 228 receives a mechanical input from the engine crank shaft or cam shaft via cam 230, thereby operating the HPP according to the principle of a cam-driven single-cylinder pump. A sensor (not shown in FIG. 2) may be positioned near cam 230 to enable determination of the angular position of the cam (e.g., between 0 and 360 degrees), which may be relayed to controller 222.

A lift pump fuel pressure sensor 231 may be positioned along fuel passage 218 between lift pump 212 and higher pressure fuel pump 214. In this configuration, readings from sensor 231 may be interpreted as indications of the fuel pressure of lift pump 212 (e.g., the outlet fuel pressure of the lift pump) and/or of the inlet pressure of higher pressure fuel pump. Readings from sensor 231 may be used to assess the operation of various components in fuel system 200, to determine whether sufficient fuel pressure is provided to higher pressure fuel pump 214 so that the higher pressure fuel pump ingests liquid fuel and not fuel vapor, and/or to minimize the average electrical power supplied to lift pump 212.

First fuel rail 250 includes a first fuel rail pressure sensor 248 for providing an indication of direct injection fuel rail pressure to the controller 222. Likewise, second fuel rail 260 includes a second fuel rail pressure sensor 258 for providing an indication of port injection fuel rail pressure to the controller 222. An engine speed sensor 233 can be used to provide an indication of engine speed to the controller 222. The indication of engine speed can be used to identify the speed of higher pressure fuel pump 214, since the pump 214 is mechanically driven by the engine 202, for example, via the crankshaft or camshaft.

First fuel rail 250 is coupled to an outlet 208 of HPP 214 along fuel passage 278. A check valve 274 and a pressure relief valve (also known as pump relief valve) 272 may be positioned between the outlet 208 of the HPP 214 and the first (DI) fuel rail 250. The pump relief valve 272 may be coupled to a bypass passage 279 of the fuel passage 278. Outlet check valve 274 opens to allow fuel to flow from the high pressure pump outlet 208 into a fuel rail only when a pressure at the outlet of direct injection fuel pump 214 (e.g., a compression chamber outlet pressure) is higher than the fuel rail pressure. The pump relief valve 272 may limit the pressure in fuel passage 278, downstream of HPP 214 and upstream of first fuel rail 250. For example, pump relief valve 272 may limit the pressure in fuel passage 278 to 200 bar. Pump relief valve 272 allows fuel flow out of the DI fuel rail 250 toward pump outlet 208 when the fuel rail pressure is greater than a predetermined pressure. Valves 244 and 242 work in conjunction to keep the low pressure fuel rail 260 pressurized to a pre-determined low pressure. Pressure relief valve 242 helps limit the pressure that can build in fuel rail 260 due to thermal expansion of fuel.

Based on engine operating conditions, fuel may be delivered by one or more port injectors 262 and direct injectors 252. For example, during high load conditions, fuel may be delivered to a cylinder on a given engine cycle via only direct injection, wherein port injectors 262 are disabled. In another example, during mid load conditions, fuel may be delivered to a cylinder on a given engine cycle via each of direct and port injection. As still another example, during low load conditions, engine starts, as well as warm idling conditions, fuel may be delivered to a cylinder on a given engine cycle via only port injection, wherein direct injectors 252 are disabled. Since fuel injection from the direct injectors results in injector cooling, after a period of inactivity, pressure may build up from fuel trapped at the DI fuel rail 250, resulting in an elevated pressure being experienced at the DI fuel rail 250 as well as HPP 214. In addition, direct injector tip temperatures may rise. Under such circumstances, the DI rail 250 pressure is required to be relieved to prevent damage to fuel system components. If at this stage the DI injectors 252 are activated to inject fuel into the engine, the rail pressure may be lowered however due to the high rail pressure, upon activation of the DI injectors 252, an impact force may be transmitted from the injectors 252 to the engine cylinder head causing a ticking noise which may be unacceptable to the operator. As elaborated herein with reference to FIG. 3, to reduce the ticking noise while reducing DI fuel rail 250 pressure, pump relief valve 272 may be opened (e.g., automatically via mechanical actuation whenever the rail pressure exceeds the HPP relief pressure) to maintain the rail pressure at or below the HPP 214 relief pressure. If further pressure relief is required, such as when a duration of DI deactivation is longer than a threshold duration, the direct injectors 252 may be intermittently activated to deliver a smaller pulse of fuel at a lower frequency into the cylinders.

In this way, by relieving at least some of the DI fuel rail 250 pressure via the pump relief valve 272, the additional pressure relief required via the direct injectors may be carried out using a smaller number of fuel pulses of a smaller pulse-width than would have been required if only direct injection were used for pressure relief. Due to the smaller size and number of fuel pulses, as well as the lower absolute pressure at which the injectors are activated, the impact force transmitted from the injectors onto the engine cylinder heads may be substantially lower, resulting in reduction of objectionable ticking noise. Also, damage to fuel system components may be reduced.

It is noted here that the high pressure pump 214 of FIG. 2 is presented as an illustrative example of one possible configuration for a high pressure pump. Components shown in FIG. 2 may be removed and/or changed while additional components not presently shown may be added to pump 214 while still maintaining the ability to deliver high-pressure fuel to a direct injection fuel rail and a port injection fuel rail.

Controller 12 can also control the operation of each of fuel pumps 212, and 214 to adjust an amount, pressure, flow rate, etc., of a fuel delivered to the engine. As one example, controller 12 can vary a pressure setting, a pump stroke amount, a pump duty cycle command and/or fuel flow rate of the fuel pumps to deliver fuel to different locations of the fuel system. A driver (not shown) electronically coupled to controller 222 may be used to send a control signal to the low pressure pump, as required, to adjust the output (e.g., speed, flow output, and/or pressure) of the low pressure pump.

FIGS. 1 and 2 show example configurations of the fuel system with relative positioning of the various components. If shown directly contacting each other, or directly coupled, then such elements may be referred to as directly contacting or directly coupled, respectively, at least in one example.

Similarly, elements shown contiguous or adjacent to one another may be contiguous or adjacent to each other, respectively, at least in one example. As an example, components laying in face-sharing contact with each other may be referred to as in face-sharing contact. As another example, elements positioned apart from each other with only a space there-between and no other components may be referred to as such, in at least one example.

Figure 3:
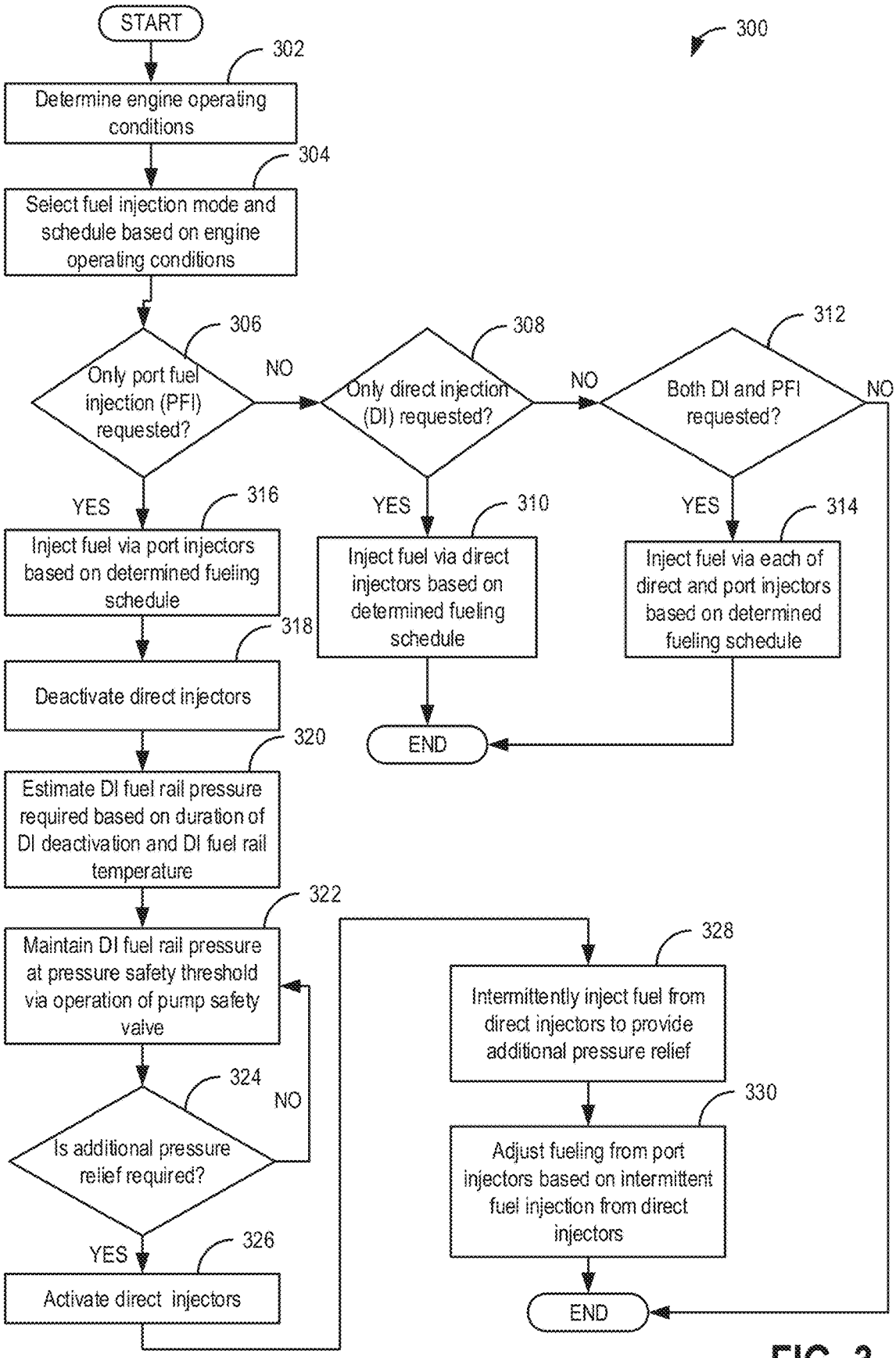
FIG. 3 shows a flow chart illustrating a method that may be implemented for relieving direct injection fuel rail pressure with reduced ticking noise.

FIG. 3 illustrates an example method 300 for relieving direct injection fuel rail pressure with reduced injector ticking noise. Instructions for carrying out method 300 and the rest of the methods included herein may be executed by a controller based on instructions stored on a memory of the controller and in conjunction with signals received from sensors of the engine system, such as the sensors described above with reference to FIGS. 1 and 2. The controller may employ engine actuators of the engine system to adjust engine operation, according to the methods described below.

At 302, engine operating conditions may be determined by the controller. The engine operating conditions may include engine load, engine temperature, engine speed, operator torque demand, etc. Depending on the estimated operating conditions, a plurality of engine parameters may be determined. For example, at 304, a fuel injection schedule may be determined. This includes determining an amount of fuel to be delivered to a cylinder (e.g., based on the torque demand), as well as an injection timing. Further, a fuel injection mode best suited for the current engine operating conditions may be selected. In one example, at high engine loads, direct injection (DI) of fuel into an engine cylinder via a direct injector may be selected in order to leverage the charge cooling properties of the DI so that engine cylinders may operate at higher compression ratios without incurring undesirable engine knock. If direct injection is selected, the controller may determine whether the fuel is to be delivered as a single injection or split into multiple injections, and further whether to deliver the injection(s) in an intake stroke and/or a compression stroke. In another example, at lower engine loads (low engine speed) and at engine starts (especially during cold-starts), port injection (PFI) of fuel into an intake port of the engine cylinder via a port fuel injector may be selected in order to reduce particulate matter emissions. If port injection is selected, the controller may determine whether the fuel is to be delivered during a closed intake valve event or an open intake valve event. There may be still other conditions where a portion of the fuel may be delivered to the cylinder via the port injector while a remainder of the fuel is delivered to the cylinder via the direct injector. Determining the fuel injection schedule may also include, for each injector, determining a fuel injector pulse-width as well as a duration between injection pulses based on the estimated engine operating conditions.

At 306, the routine includes determining if only port fuel injection has been requested based on the current engine operating parameters. Only PFI may be requested, for example, during conditions of low engine load and low engine temperature, as well as engine starts. If it is determined that PFI is not currently being requested, at 308, the routine may include determining if only direct injection has been requested. DI may be desirable, for example, during high engine load and/or during conditions of high engine temperature. If it is determined that only DI is requested, at 310, fuel may be injected into the engine via the direct injectors (such as the direct injectors 252 in FIG. 1). The controller may adjust an injection pulse-width of the direct injectors in order to provide fuel via the direct injectors according to the determined fueling schedule.

If it is determined that only PFI and only DI is not desired for fueling, at 312, the routine may determine if both DI and PFI are requested for fuel injection. If it is determined that both direction injection and port injection has been requested, at 314, the controller may send a signal to actuators coupled to each of the direct injector and the port injector to initiate fueling based on a determined fueling schedule. Each injector may deliver a portion of a total fuel injection that is combusted in the cylinder. As described in FIG. 2, the distribution and/or relative amount of fuel delivered from each injector may vary based on operating conditions, such as engine load, knock, exhaust temperature, etc.

Returning to 306, if it is determined that only PFI is desired, at 316, the controller may command the determined pulse width to the port injector (such as the port injectors 262 in FIG. 1) to initiate fuel injection. In addition, at 318, the controller may deactivate the direct injectors.

As such, when direct injection is deactivated, fuel may not be delivered to the cylinder via the direct injection fuel rail (such as the DI fuel rail 250 in FIG. 2) and the direct injectors. Consequently, any fuel trapped inside the DI fuel rail may expand due to high temperatures. This can result in a pressure build-up at the DI fuel rail. Since fuel injection results in injector cooling, the lack of direct injection also results in elevated injector tip temperatures. As such, if the direct injectors are held disabled for an extended period of time, the pressure built up in the fuel rail may be significant, and may cause damage to various fuel system components.

At 320, while the direct injectors are disabled, a pressure at the DI fuel rail may be estimated (e.g., predicted or modeled) by the controller. In one example, the expected pressure may be based on the duration of DI deactivation and the DI fuel rail temperature. The longer the duration of DI deactivation and/or the higher the fuel rail temperature, the higher the expected fuel rail pressure. The DI fuel rail pressure may also be determined based on input from a fuel rail pressure sensor (such as the DI fuel rail pressure sensor 248 in FIG. 2). In an alternate example, the expected pressure at the DI fuel rail may be modeled based on a duration of operation in the port injection only mode.

A pump relief valve (such as valve 272 in FIG. 2) may be coupled to a bypass passage of the fuel passage between the high pressure pump (HPP) and the direct injection fuel rail, and this valve may ensure that the DI fuel rail pressure does not increase beyond a pressure relief threshold of the HPP. At 322, if the DI fuel rail pressure exceeds the HPP pressure relief threshold (e.g., a first threshold), the pump relief valve coupled to the HPP may open to maintain the rail pressure at the first threshold pressure. In one example, the valve may be a mechanical valve that is automatically actuated open whenever the fuel rail pressure in the DI fuel rail exceeds the first threshold to release fuel into the fuel passage via the bypass passage. The valve may likewise be automatically actuated closed once the fuel rail pressure in the DI fuel rail reaches the first threshold, or below it. In alternate examples, the valve may be electrically actuated open and closed responsive to the fuel rail pressure. Valve opening enables the fuel rail pressure to be lowered as well as a lower injector tip temperature of the direct injectors. However, during prolonged operation of the fuel system with the DI deactivation and increased DI fuel rail temperature, further pressure relief in the DI fuel rail may be desired to prevent any damage to the fuel system components. At 324, the routine includes determining if a further reduction in pressure is required, for example to a second threshold below the first threshold. In one example, the second threshold corresponds to a lower pressure in the DI fuel rail where fuel component damage is averted. As an example, further reduction in pressure may be requested if the direct injectors have been disabled for a prolonged period and/or if the temperature of the HPP is higher than a threshold temperature (e.g., HPP temperature exceeds 100° C.).

If it is determined that further decrease in pressure below the HPP pressure relief threshold (first threshold) is desired (e.g., if the HPP temperature is higher than a threshold), at 326, the controller may send a signal to activate the DI injectors. If HPP temperature is higher than the threshold, it is required to activate DI (HPP fuel pump and direct injectors) in order to prevent fuel vapors from entering the HPP chamber, thereby increasing HPP durability. Once the DI injectors are activated, at 328, DI injectors may be used to inject fuel into the engine to provide the requested additional pressure relief to the second lower threshold. For example, the controller may command a duty cycle to the injectors to inject fuel at a plurality of fuel injection pulses of small pulse-width, the pulses delivered at a lower frequency. As such, if only direct injection were used to provide all the pressure relief (e.g., to the first threshold and then to the lower threshold), such as if the injectors were activated at 322, a high impact force would have been transmitted from the injectors onto the engine cylinder heads. This force may have produced a ticking noise in the vehicle that may have been objectionable to the vehicle operator. As such, the higher the rail pressure, the louder the ticking noise that is generated. Also, during DI, operation of an engine cooling fan may entirely mask any objectionable noise produced by the DI injectors. Therefore by using the pump relief valve, DI fuel rail pressure may be limited to a specified pressure relief limit without the occurrence of the objectionable ticking noise. In this way, by relieving at least some of the pressure via the pump relief valve (down to the first threshold), the additional pressure relief required via the direct injectors may require a smaller number of fuel pulses as well as fuel pulses of a smaller pulse-width than would have been required if only direct injection were used for pressure relief. Due to the smaller size and number of fuel pulses, as well as the lower absolute pressure at which the injectors are activated, the impact force transmitted from the injectors onto the engine cylinder heads may be substantially lower, resulting in reduced occurrence (also of lower volume) of the objectionable ticking noise.

At 330, fueling from the port injectors may be adjusted to account for the intermittent fuel injection from the DI injectors. Since additional fuel is being injected from the DI injectors during DI fuel rail pressure relief, the fueling schedule may have to be adjusted for the PFI injectors to maintain the amount of fuel delivered to the cylinders, as well as to maintain the combustion air-fuel ratio at the target air-fuel ratio (e.g., at or around stoichiometry). For example, in response to fuel injection via the direct injector, a corresponding reduction in fuel amount may be effected at the port injector.

In this way, by primarily using the pump relief valve in combination with intermittent DI, DI fuel rail pressure may be relieved with reduced ticking noise and reduced damage to the fuel system components.

FIG. 4 shows an example operating sequence 400 illustrating an engine operating with a fuel system (e.g., such as the fuel system 200 shown in FIG. 2), and release of direct injection (DI) fuel rail pressure with reduced ticking noise. The method shows use of a pump relief valve with intermittent activation of the DI injectors for relief of DI fuel rail pressure with reduced ticking noise. The horizontal axis (x-axis) denotes time and the vertical markers t1-t5 identify significant times in the operation of the fuel system.

The first plot, line 402, from the top shows variation in engine load over time. The second plot, line 404, shows pressure in the DI fuel rail. Dotted lines 405, 406 and 407 show significant pressure values in DI rail pressure. Pressure difference values $\Delta P_1$ and $\Delta P_2$ shows difference in DI rail pressure from the previously mentioned significant pressure values. In the third plot, lines 408 and 409 show modes of operation of direct injection. DI can be either active or deactivated. Similarly the fourth plot, line 410, shows mode of operation of the port injection. PFI can be either active or deactivated. The fifth plot, line 412, shows the state (open or closed) of a pump relief valve. The pump relief valve is a spill valve that may automatically open (mechanically) to reduce DI fuel rail pressure when the pressure exceeds a threshold. The sixth plot, line 414, shows variation of a pressure relief index over time. During, deactivation of DI, pressure builds up in the DI fuel rail. Accordingly, a pressure relief index may be formulated to quantify the pressure built up in the DI fuel rail. Therein, as the fuel rail pressure increases, the pressure relief index may be increased, indicative of the need for more pressure relief. Dotted lines 415 and 416 show the upper and lower threshold values, respectively, for the pressure relief index. The seventh and final plot includes lines 417 and 418 which show the Tick Knock Indices (TKI) of a ticking noise produced on intermittent activation of DI during high DI rail pressure conditions at two different frequencies. TKI is used herein as a metric for quantification of periodic impulsiveness, which in this case is the injector ticking noise.

Prior to time t1, the engine load may be high and fuel may be injected in the engine via DI. During this time period, based on engine operating conditions, DI may be solely used for fuel injection and the port injection (PFI) may be maintained in a deactivated state. Due to the use of DI, pressure may not build up significantly in the DI fuel rail during this time and the pressure relief index is low. Due to the low DI fuel rail pressure, the pump relief valve may remain in a closed position. As the DI is operating with low DI fuel rail pressure, no ticking noise is produced at this time.

At time t1, the engine speed may decrease to a region where only PFI is desired for engine operation. Consequently, the direct injectors may be deactivated and PFI may be activated to deliver fuel to the engine. Between time t1 and t2, as the DI is maintained in deactivated mode, fuel trapped inside the DI fuel rail may expand due to high temperatures at the fuel rail and injector, resulting in a pressure build-up in the DI fuel rail. The DI fuel rail pressure is seen to increase steadily during this period. However, between t1 and t2, the fuel rail pressure remains below a high pressure pump (HPP) pressure relief threshold (herein a first threshold denoted by dotted line 406). Consequently, the pump relief valve remains in the closed position.

At time t2, the DI fuel rail pressure increases beyond the first threshold 406 causing the pump relief valve to open to spill fuel and release enough pressure to return the DI fuel rail pressure to or below the first threshold. This process is repeated a number of times between time t2 and t3. Every time the DI fuel rail pressure exceeds the first threshold, the pump relief valve is opened to drop the pressure to a value below the first threshold. In this way, without the requirement of DI activation, DI fuel rail pressure may be maintained within the first threshold.

If only DI were used to address the rail pressure issue, larger amounts of fuel may have had to be released more frequently from the direct injectors in order to bleed-off the excess pressure in the DI fuel rail. Plot 408 shows example fuel pulses that may have had to be delivered if only direct injection were used for DI fuel rail pressure relief. In the depicted example, DI pulses having a pulse width of W1 are injected with an interval of I1. Therein, due to a higher impact force transmitted from the direct injectors onto the engine cylinder heads during the pressure relief injection, a high volume ticking noise may be generated in the vehicle, as indicated at 417. In particular, due to a larger difference (ΔP1) between a pressure at which the pressure relief injection is initiated (denoted by line 405) and a pressure at which the pressure relief injection is terminated (denoted by lower threshold 407) a louder ticking noise is generated. In particular, the ticking noise (as represented by TKI 417) would have been proportional to pressure difference ΔP1. Therefore by allowing the pump relief valve to address the fuel rail pressure while maintaining the DI disabled DI fuel rail pressure may be maintained within a specified pressure relief limit without the occurrence of the objectionable ticking noise.

Between time t2 and t3, as the period of DI inactivity increases, the pressure relief index may increase and additional pressure relief may be required. Additionally, direct injector tip temperature control may be required. Even if the pump relief valve spills excess pressure above the first threshold, the prolonged presence of relatively high pressure (at first threshold) in the fuel rail may cause increase in the pressure relief index. At time t3, based on the pressure relief index reaching an upper threshold value 415, a further reduction in DI fuel rail pressure to below the first threshold (to the second threshold) may be desired in order to reduce any potential damage to the fuel system components. Between time t3 and t4, DI may be intermittently activated and small pulses of fuel of lower frequency may be delivered to the engine via the DI injectors. In particular, in the depicted example, DI pulses having a pulse width of W2 (smaller than pulse width W1) are injected with an interval I2 (larger than interval I1), as can be seen by comparing the direct injection at t3-t4 to the hypothetical injection at t2-t3.

In this way, the remainder (below first threshold) of the built-up DI fuel rail pressure may be relieved until the DI fuel rail pressure reaches the second threshold 407. The decrease in the pressure relief index is directly proportional to the decrease in DI fuel rail pressure from the first threshold to the second threshold. The intermittent fuel injection using DI may be continued until the pressure relief index reaches a lower threshold 416.

As some of the built-up pressure has already been relieved by the use of the pump relief valve, the additional pressure relief required via the direct injectors results in less ticking. In particular, due to a smaller difference (ΔP2) between a pressure at which the pressure relief injection is initiated (denoted by line 407) and a pressure at which the pressure relief injection is terminated (denoted by lower threshold 407??), a quieter ticking noise is generated, as indicated by TKI 418. In particular, the ticking noise (as represented by TKI 418) would have been proportional to the smaller pressure difference ΔP2. In addition, due to the smaller size and number of fuel pulses, as well as the lower absolute pressure at which the injectors are activated, the impact force transmitted from the injectors onto the engine cylinder heads may be substantially lower, resulting in reduced damage to fuel system components.

Between time t3 and t4, when the DI injectors are periodically activated, the PFI injectors may continue to be maintained in the active mode however, fueling schedule for PFI may be adjusted taking into account the fuel being injected by the DI injectors.

Due to the intermittent activation of the DI, at t4, the DI fuel rail pressure may be at the second threshold value. At this time DI is no longer required and the DI injectors are once again deactivated. Between time t4 and t5, fuel injection may be continued via the PFI injectors. The DI fuel rail pressure and the pressure relief index is low during this time period without any further requirement of pressure relief. At time t5, the engine load may increase and consequently DI may be desired instead of PFI. Therefore at this time, the PFI may be deactivated and the DI may be activated to deliver fuel to the combustion chamber. In this way, pressure may be effectively relieved from a DI fuel rail thereby reducing any possibility of damage in fuel rail components and producing reduced objectionable ticking noise.

FIG. 5A shows an example bar chart 500 comparing ticking noise levels produced using different techniques for direct injection (DI) fuel rail pressure relief. As explained in details in relation to FIGS. 3 and 4, during prolonged period of DI injector inactivity (when fueling is being carried out via port injection), pressure may build up in the DI injector fuel rail. Such pressure build up may cause damage to different fuel system components.

In one example, in order to relief DI fuel rail pressure while direct injection is disabled, small amounts of fuel may be intermittently released from the direct injectors in order to bleed-off the excess pressure in the direct injection fuel rail and lower the tip temperature. This method of DI fuel rail pressure may be termed as maintenance mode (MM). Activation of the direct injection (DI) injector for rail pressure relief generates a high impact force that is transmitted from the injectors onto the engine cylinder heads generating a ticking noise in the vehicle that may be objectionable to the vehicle operator. The volume of the ticking noise heard at different parts of the vehicle when pressure relief is carried out in maintenance mode is shown in the bar chart 500. The difference parts of the vehicle include driver wheel, driver door, and passenger wheel and vehicle front. The targets of the ticking noise at each vehicle part is shown by the dotted lines 502. As seen from the bar chart by using the above mentioned method for pressure relief (MM), the level of ticking noise is significantly higher than the targets.

In another example, as the rail pressure exceeds a first threshold pressure that corresponds to a high pressure pump relief pressure, a pump relief valve coupled to the HPP may intermittently open (e.g., automatically via mechanical actuation) to maintain the rail pressure at the first threshold pressure. If further pressure relief is required, only then the direct injectors may be intermittently activated to deliver a small pulse of fuel into the cylinders. By relieving at least some of the pressure via the pump relief valve, the additional pressure relief required via the direct injectors may require a smaller number of fuel pulses as well as fuel pulses of a smaller pulse-width than would have been required if only direct injection were used for pressure relief. Due to the smaller size and number of fuel pulses, as well as the lower absolute pressure at which the injectors are activated, the impact force transmitted from the injectors onto the engine cylinder heads may be substantially lower, resulting in reduced occurrence of objectionable ticking noise. This method of DI fuel rail pressure may be termed as Pressure Relieve Valve (PRV) mode. As seen from the bar chart by using the second method for pressure relief (PRV mode), the level of ticking noise detected at all the vehicle parts is lower than the target volume. Therefore it may be ascertained that by using the PRV mode, DI fuel rail pressure may be effectively reduced with less ticking noise.

FIG. 5B shows the data presented in the bar chart of FIG. 5A in a tabulated form 510. In this table the absolute ticking noise levels detected at different vehicle parts during operations in maintenance mode and pressure relieve valve mode are shown. Also a difference in target ticking noise level and the detected noise level is provided. It can be observed that the best compliance to the target noise levels occurs during operation in the pressure relieve valve mode. The lower volume ticking noise as heard in the pressure relieve valve mode may be low enough to be masked by engine noise such that it is not audible (or objectionable) to the operator.

FIG. 6 shows two example plots of direct injection (DI) fuel rail pressure release using two different techniques. Plot 610 shows DI fuel rail pressure release using the pressure relieve valve mode as described in FIG. 5 and the plot 620 shows DI fuel rail pressure release using the maintenance mode as discussed in FIG. 5. In the plots 610 and 620, the x-axes show time, the first y-axes show DI fuel rail pressure amplitude (in psi) and the second y-axes show electric current amplitude (in A). In plot 610, the line 602 shows variation in DI fuel rail pressure over time and the line 604 shows that the amplitude of electric current remains constant at zero over time (no electric current flowing through the DI injectors). In plot 620, the line 606 shows variation in DI fuel rail pressure over time and the line 608 shows that change in amplitude of electric current over time (activation of DI).

The current may be supplied to the DI for activation. During the time period when the DI is maintained in the deactivated mode, there is no current flowing through the DI injectors. As seen in plot 610, the fuel rail pressure is maintained at a threshold corresponding to the fuel system high pressure pump (HPP) pressure relief limit (first threshold) without the requirement of DI activation. During prolonged periods of DI deactivation, the DI fuel rail pressure may tend to increase (due to fuel trapped in the fuel rail under high temperature conditions) beyond the first threshold which may cause potential damage to fuel system components. In the pressure relieve valve mode, as the DI fuel rail pressure increases beyond the first threshold, a HPP relief valve may open intermittently bleed-off some of the DI fuel rail pressure in order to decrease the pressure below the first threshold. In this way, the Di fuel rail pressure may be maintained at a desirable level below the first threshold without the requirement to activate the DI injectors. If further pressure relief below the threshold is desired only then the DI injectors may be intermittently activated to relief the remaining pressure. Details relating to this method has been described in details with relation to FIG. 3.

In the maintenance mode (as shown in plot 620), as the Di fuel rail pressure increases beyond a threshold, instead of intermittent pressure bleed-off via the pump relief valve, the DI injectors are activated to reduce the DI fuel rail pressure. Electric current in supplied to the injectors in order to activate them periodically or opportunistically to reduce the DI fuel rail pressure. However, in this method as the fuel rail pressure is not reduced using the pump relief valve, more frequent pulses (also with high pulse width) of DI may be required to reduce the built-up pressure. Due to such events of DI activation there may be increased ticking noise in the engine which may be objectionable to the operator. In addition due to the high level of pressure in the DI fuel rail, the impact force from the DI injectors onto the cylinder heads (the cause for the ticking noise) may be high thereby increasing the possibility of damage in the fuel system components.

In this way, in the pressure relieve valve mode, by limiting the requirement for DI activation, transmission of impact force from the DI injectors onto the cylinder heads may be limited thereby reducing the objectionable ticking noise and any potential damage to the fuel system components.

One example method comprises during an engine warm idling condition, maintaining direct injectors disabled until a direct injection fuel rail pressure is reduced a high pressure pump relief valve; and then further reducing the direct injection fuel rail pressure via intermittent activation of the direct injectors. In the preceding example, additionally or optionally, the warm idling condition includes running the engine below a threshold speed and supplying fuel to the engine via a port injector only. In any or all of the preceding examples, additionally or optionally, the direct injectors are maintained disabled until the direct injection fuel rail pressure is at or below a first threshold pressure. In any or all of the preceding examples, additionally or optionally, the first threshold pressure is a pressure setting of the high pressure pump relief valve. In any or all of the preceding examples, additionally or optionally, the intermittent activation of the direct injector is based on a duration elapsed the direct injectors were disabled. In any or all of the preceding examples, additionally or optionally, the further reducing includes intermittently injecting fuel via the direct injectors until the fuel rail pressure reduces to a second threshold pressure, lower than the first threshold pressure. In any or all of the preceding examples, additionally or optionally, a fuel pulse-width and interval of the intermittently injecting is based on a difference in pressure between the first and second threshold. Any or all of the preceding examples, further comprises, additionally or optionally, deactivating the direct injector when the direct injection fuel rail pressure reached the second threshold pressure. In any or all of the preceding examples, additionally or optionally, the high pressure pump relief valve is a mechanically actuated valve. Any or all of the preceding examples, further comprises, additionally or optionally, adjusting fueling via the port injector based on the intermittent injection via the direct injector.

Another example method for an engine exhaust comprises delivering fuel to an engine cylinder via a port injector while maintaining a direct injector disabled; during a first condition, reducing pressure at a fuel rail of the direct injector by opening a pump relief valve while maintaining the direct injector disabled; and during a second condition, first reducing pressure at the fuel rail of the direct injector by opening the pump relief valve while maintaining the direct injector disabled, and then further reducing the pressure by intermittently enabling the direct injector. In the preceding example, additionally or optionally, during the first condition, the direct injector were disabled for a shorter duration before the pump relief valve is opened, and during the second condition, the direct injectors were disabled for a longer duration before the pump relief valve is opened. In any or all of the preceding examples, additionally or optionally, during the first condition a pressure relief index is smaller, and during the second condition the pressure relief index is higher, wherein the pressure relief index is a measure of a requirement of fuel rail pressure relief based on each of a duration of direct injection deactivation and engine operating conditions. Any or all of the preceding examples, further comprises, additionally or optionally, during a third condition, reducing pressure by intermittently enabling the direct injector while maintaining the pump relief valve closed. In any or all of the preceding examples, additionally or optionally, the intermittently enabling of the direct injector during the second condition includes fuel injection with a first pulse width and a first frequency, and the intermittently enabling of the direct injector during the third condition includes fuel injection with a second pulse width and a second frequency, the second pulse width is larger than the first pulse width and the second frequency is higher than the first frequency. Any or all of the preceding examples, further comprising, additionally or optionally, adjusting fueling via port injection based on intermittent fueling during each of the first, second and third condition via direct injection.

In yet another example, a fuel system comprises a first fuel rail coupled to a direct injector; a second fuel rail coupled to a port injector; a high pressure pump coupled to a fuel line leading to the first fuel rail; a fuel tank; a low pressure fuel pump coupled to the fuel tank; a pump relief valve coupled upstream of the high pressure fuel pump, between the high pressure fuel pump and the first fuel rail, wherein the pump relief valve is configured to maintain a fixed fuel pressure in the first fuel rail; and a controller including non-transitory instructions for intermittently activating direct injection only if a further pressure relief below the fixed fuel pressure is requested. In the preceding example, additionally or optionally, the pump relief valve is one of a mechanical valve and an electrically actuated valve. In any or all of the preceding examples, additionally or optionally, intermittently activating direct injection includes activating fuel injection via direct injection for a certain duration while maintaining port injection active. Any or all of the preceding examples, further comprises, additionally or optionally, adjusting port injection based on intermittent activation of direct injection. In this way, pressure built-up in a DI fuel rail may be relieved with reduced occurrence of an objectionable ticking noise. By enabling DI fuel rail pressure to be reduced below a relief threshold of the HPP via operation of the pump relief valve, the direct injectors may be maintained deactivated for a longer duration, reducing the occurrence of ticking. By reducing the pressure to a level below the relief threshold via operation of the pump relief valve, even when the direct injectors are activated for pressure relief, a smaller degree of pressure relief is required via the injectors therefore the amount of objectionable noise generated may be substantially lower, or even negligible. Also, by reducing the activation frequency of the DI injectors, impact force on the cylinder head from the DI injectors is reduced thereby reducing any risk of component damage and warranty related issues.

In this way, pressure built-up in a DI fuel rail may be relieved with reduced occurrence of an objectionable ticking noise. By enabling DI fuel rail pressure to be reduced below a relief threshold of the HPP via operation of the pump relief valve, the direct injectors may be maintained deactivated for a longer duration, reducing the occurrence of ticking. By reducing the pressure to a level below the relief threshold via operation of the pump relief valve, even when the direct injectors are activated for pressure relief, a smaller degree of pressure relief is required via the injectors therefore the amount of objectionable noise generated may be substantially lower, or even negligible. Also, by reducing the activation frequency of the DI injectors, impact force on the cylinder head from the DI injectors is reduced thereby reducing any risk of component damage and warranty related issues.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein. The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A method, comprising:

operating a turbocharged engine at an engine load with direct fuel injectors injecting fuel and a direct injection fuel rail pressure below a threshold, and then decreasing engine output to reduce engine speed to a region where only port fuel injection is used to deliver fuel to the engine by disabling the direct fuel injectors while pressure in the direct injection fuel rail builds;

continuing at the reduced engine speed; and maintaining direct injectors disabled until the direct injection fuel rail pressure is reduced by a high pressure pump relief valve; and then further reducing the direct injection fuel rail pressure toward the threshold via intermittent activation of the direct injectors.

2. The method of claim 1, wherein the first threshold pressure is a pressure setting of the high pressure pump relief valve.

3. The method of claim 1, wherein the intermittent activation of the direct injector is based on a duration elapsed while the direct injectors were disabled.

4. The method of claim 3, wherein the further reducing includes intermittently injecting fuel via the direct, wherein a fuel pulse-width or interval of the intermittently injecting is based on a difference in pressure between the first and second threshold.

5. The method of claim 3, wherein the further reducing includes intermittently injecting fuel via the direct, wherein a fuel pulse-width and interval of the intermittently injecting is based on a difference in pressure between the first and second threshold.

6. The method of claim 1, wherein a port fuel injection rail is coupled to upstream of a high pressure fuel pump.

7. The method of claim 6, wherein the port injection fuel rail and direct injection fuel rail are both downstream of the same low pressure fuel pump.

8. The method of claim 1, wherein the high pressure pump relief valve is a mechanically actuated valve.

9. The method of claim 1, further comprising adjusting fueling via the port injector based on the intermittent injection via the direct injector.

10. The method of claim 1, wherein port and direct injectors of the engine inject gasoline from a common tank.

11. The method of claim 1, wherein the engine is a spark-ignition engine.

12. A method, comprising:

delivering fuel to an engine cylinder via a port injector while maintaining a direct injector disabled;

during a first condition, higher fuel rail pressure at a fuel rail of the direct injector, reducing pressure at the fuel rail by opening a pump relief valve while maintaining the direct injector disabled; and during a second, lower fuel rail pressure condition, first reducing pressure at the fuel rail of the direct injector by opening the pump relief valve while maintaining the direct injector disabled, and then further reducing the pressure by intermittently enabling the direct injector.

13. The method of claim 12, further comprising during a third condition, reducing pressure by intermittently enabling the direct injector while maintaining the pump relief valve closed.

14. The method of claim 11, wherein during the first condition, the direct injector were disabled for a shorter duration before the pump relief valve is opened.

15. The method of claim 14, wherein during the second condition, the direct injectors were disabled for a longer duration before the pump relief valve is opened.

16. The method of claim 12, wherein during the first condition a pressure relief index is smaller.

17. The method of claim 16, wherein during the second condition the pressure relief index is higher.

* * * * *